United States Patent [19]

Lin et al.

[11] 4,364,020

[45] Dec. 14, 1982

[54] AMORPHOUS METAL CORE LAMINATIONS

[75] Inventors: Kou C. Lin, Hermitage; Belvin B. Ellis, Sharon, both of Pa.

[73] Assignee: Westinghouse Electric Corp., Pittsburgh, Pa.

[21] Appl. No.: 232,274

[22] Filed: Feb. 6, 1981

[51] Int. Cl.[3] ..... H01F 27/24

[52] U.S. Cl. ..... 336/212; 336/216; 336/218; 336/219

[58] Field of Search ..... 336/212, 213, 218, 219, 336/233, 234, 211, 216, 217; 360/126; 75/123 K, 123 L, 122, 123 R; 148/121, 110

[56] References Cited

U.S. PATENT DOCUMENTS

| | | | |
|---|---|---|---|
| 1,910,227 | 5/1933 | Austin | 336/219 X |
| 2,372,074 | 3/1945 | Ford | 336/218 X |
| 3,267,557 | 8/1966 | Olsen et al. | 336/213 X |
| 3,404,360 | 10/1968 | Woodward | 336/211 |
| 3,496,506 | 2/1970 | Seidel et al. | 336/219 X |
| 3,513,423 | 5/1970 | Russell | 336/210 |
| 3,538,474 | 11/1970 | Olsen | 336/212 |
| 4,025,379 | 5/1977 | Whetstone | 336/219 X |
| 4,205,288 | 5/1980 | Lin et al. | 336/212 X |

*Primary Examiner*—Thomas J. Kozma
*Attorney, Agent, or Firm*—L. P. Johns

[57] ABSTRACT

A magnetic core for use with electrical windings characterized by a plurality of groups of butt-jointed laminations of high permeability, amorphous material with each lamination group having a layer of protective material surrounding the outermost lamination and comprising a strip of material having a melting point above the temperature range of from about 340° C. to 420° C., whereby each lamination group is protected from damage during handling.

3 Claims, 4 Drawing Figures

AMORPHOUS METAL CORE LAMINATIONS

BACKGROUND OF THE INVENTION

1. Field of the Invention

This invention relates to a magnetic core for use with electrical windings, and, more particularly, it pertains to strips for protecting amorphous metal core laminations.

2. Description of the Prior Art

Magnetic materials used in the magnetic cores of electrical power and distribution transformers have been improved over the years to enable the size and manufacturing costs of a transformer to be reduced. More recently, amorphous metal of electrical type steels have been used for winding transformer cores. However, inasmuch as amorphous metal strip has an extremely thin gauge and is extremely brittle, it is very difficult to provide an amorphous metal wound core without shipping or breaking the ends or edges of the core laminations. This is especially true where the material is annealed. Indeed, a particular problem occurs in the handling of a wound core of amorphous metal where the core is wrapped around the legs of a transformer coil during assembly. Accordingly, there has been a need for a more desirable procedure for handling and assembling cores on transformer coils.

SUMMARY OF THE INVENTION

It has been found in accordance with this invention that a more satisfactory magnetic core may be provided which comprises a plurality of step-lapped, butt-jointed laminations of high permeability, amorphous metal, each lamination being a closed loop having a single joint, the laminations being nested together within one another to form groups of laminations one within another, and each lamination group having a layer of protective material surrounding the outermost lamination which material comprises an oriented 3% silicon steel having high permeability in the direction of grain orientation, whereby each lamination group is protected from damage during handling.

The advantage of the magnetic core structure of this invention is that the layer of protective material on each group of laminations protects the ends and edges of the amorphous metal laminations from chipping or breaking during core processing and core-coil assembling.

DESCRIPTION OF THE PREFERRED EMBODIMENTS

Figure 1:
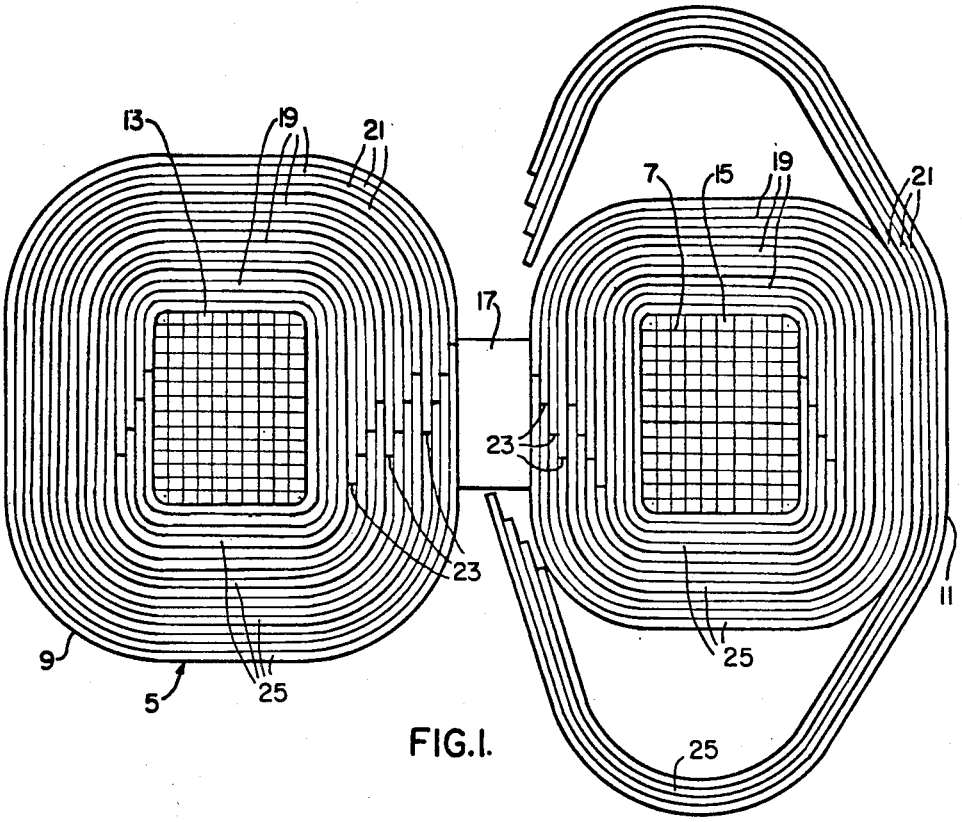
FIG. 1 is a sectional view through two legs of a transformer coil, and illustrating core sections built through the window of a typical core structure and illustrating the manner in which the sections are built upon one another to form a complete core.

In FIG. 1 a transformer coil-core structure is generally indicated at 5 and it comprises a coil 7, and cores 9, 11. The coil 7 includes a pair of legs 13, 15 as well as interconnecting portions between the legs, one of which portions 17 is shown. The legs 13, 15 are disposed within similar windows of the lefthand and righthand cores 9, 11, the latter of which is shown in the partially assembled condition.

Figure 2:
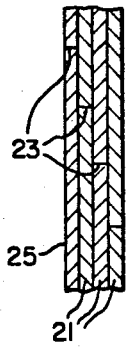
FIG. 2 is an enlarged fragmentary, sectional view of the step-lap joint between opposite ends of laminations of a section of laminations, and showing a layer of protective material surrounding the outermost lamination of the section.

Both cores are comprised of groups or sections 19 of cores which are concentrically disposed with respect to each other. Each section 19 includes a plurality of butt-jointed laminations 21 of high permeability material with each lamination being a closed loop having a single butt-joint 23. The butt-joints 23 for the laminations of each section are step-lapped or staggered as shown in FIG. 2.

In accordance with this invention, the laminations 21 of high permeability material are comprised of an amorphous metal or alloy, such as 2605 SC material ($Fe_{18}B_{13.5}Si_{3.5}C_2$ Atomic Percent) of Allied Corporation, Morristown, N.J., or any alloys suitable for magnetic core material. Inasmuch as amorphous metals and alloys are extremely brittle, which is especially true after being annealed, it is difficult to assemble the core-coil structure 5 in the manner shown for the righthand portion, as shown in FIG. 1, without damaging the amorphous metal laminations, such as by chipping or breaking. Since as each section 19 is assembled separately from the inner section out, the problem of chipping the laminations is particularly acute when the step-lapped butt-joints 23 are fitted together.

To prevent or minimize damage to the laminations, each lamination section 19 includes an outer layer in the form of a strip or lamination 25 of a material having a melting point above the temperature range of from about 340° C. to 420° C., in which the temperature range the sections are annealed prior to assembly with the coils. More particularly, the strip or lamination 25 of protective material is an oriented silicon steel having high permeability in the direction of grain orientation which is comprised of about 3% silicon with the balance being iron and some impurities. This silicon steel alloy is commonly referred to as Hipersil (a trademark of Westinghouse Electric Corporation) which is a thin gauge soft strip which protects the ends and edges of the amorphous metal laminations from chipping during core processing and core-coil assembly. Each section 19 includes at least an outer lamination 25, although each section may also be provided with an inner protective layer of lamination (not shown).

Although the preferred material is 3% silicon steel, other materials which are electrically conductive, such as copper and aluminum, may be used with lesser benefit due to their lower permeability characteristics. A non-metal, such as a resin, may be used, but because of its non-electrical character, decreases the space factor of the core.

Figure 4:
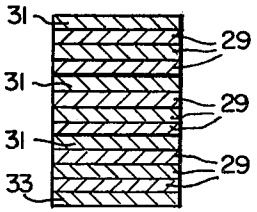
FIG. 4 is a vertical sectional view taken on the line IV—IV of FIG. 3.
Figure 3:
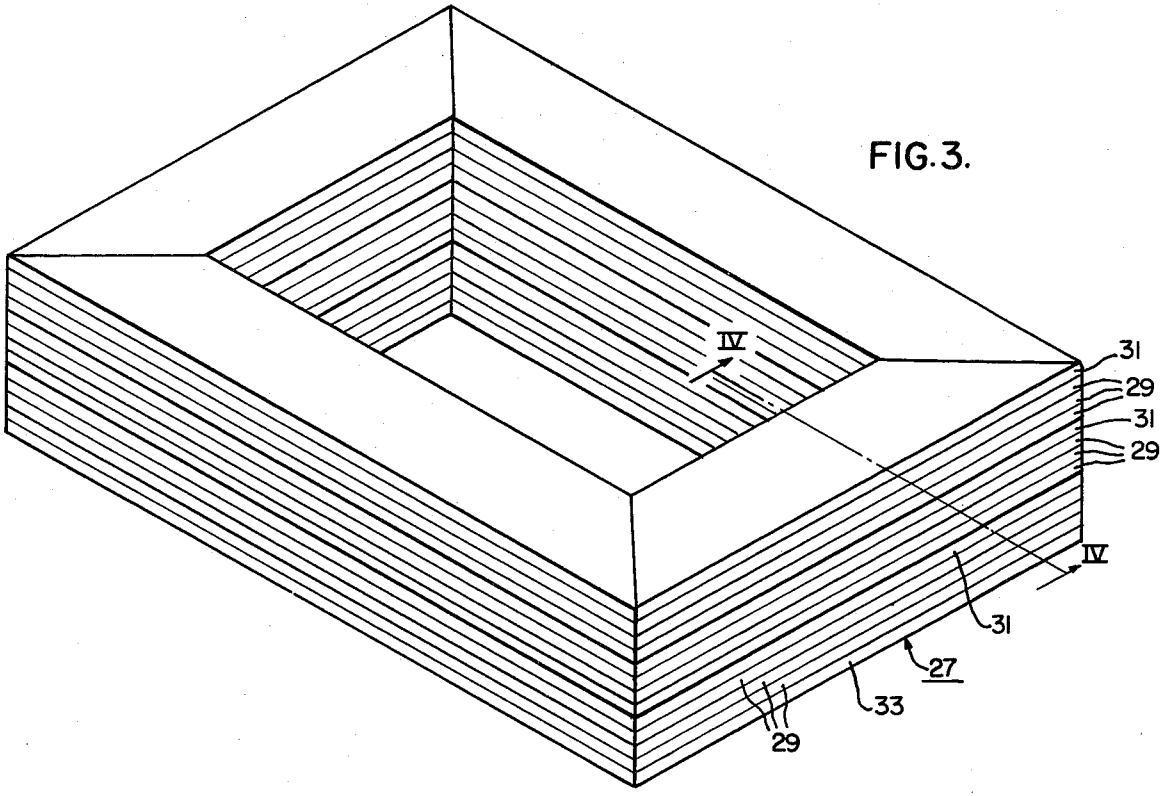
FIG. 3 is an isometric view of a laminated core of another embodiment.

Another embodiment of the invention is a "stacked core" generally indicated at 27 (FIG. 3). The core 27 is comprised of a plurality of sections, such as three sections shown for illustration, which comprise a plurality of laminations 29 of amorphous metal or alloy, similar to that described in the embodiment of FIGS. 1 and 2. Here again, the laminations 29 are assembled in groups or sections of a plurality of laminations with a protective layer of strip or lamination 31 being provided at the top of each section. In addition, a protective layer of strip or lamination 33 (FIG. 4) may also be provided on the lower side of the lowermost section of laminations 29 to protect the laminations 29 of the lower section. The layer or strip of laminations 31, 33 are comprised of a material similar to the layers or strips of laminations 25 as described above.

The following example is exemplary of the invention:

EXAMPLE

The feasibility of using thin gauge Hipersil strip placed at the outer wrap of each section of laminations was magnetically evaluated. The true watt loss was 6.8% and the exciting power was 10.5% higher at 13 kG for the wound core with Hipersil strips than those of the plain amorphous metal wound core (compare 0.126 watt/lb. to 0.118 watt/lb., and 0.430 VA/lb. to 0.380 VA/lb. in the Table). The inferior magnetic performance of the wound core with Hipersil strips can be improved if the build up height of each group of laminations is increased. The build up height of each group of laminations was 3/32" for the test core which has a mean circumference of 5.5", while the general build up height for each group of a commercial wound core is 3/16" to 3/8" and the mean circumference of the core is 20" or greater.

During the core dismantling and assembling practices, it was noticed that the Hipersil strip provided adequate protection for handling group laminations, but physically the strip itself did not take a permanent set from annealing at 360° C. to 365° C. for 2 hours. The Hipersil strip was still springy for a small wound core. Therefore, copper and aluminum strips were used instead of Hipersil strip in a small wound core for evaluation. The Table also compares performances of a wound core with copper and aluminum strips to the performance of a wound core with Hipersil strip. There was 6.3% difference in the true watt loss and 39.3% in the exciting power at 13 kG. The difference in performance can be minimized as stated if the core size and build up height are increased.

TABLE

AMORPHOUS METAL WOUND CORE WITH PROTECTION OF HIPERSIL STRIPS, OR ALUMINUM AND COPPER STRIPS

| Ind | Plain Amorphous Metal Wound Core | | Wound Core With Hipersil | | Wound Core With Cu & Al | |
|---|---|---|---|---|---|---|
| (kG) | TW/# | VA/# | TW/# | VA/# | TW/# | VA/# |
| 12 | .098 | .253 | .098 | .241 | .104 | .398 |
| 12.6 | .112 | .321 | .112 | .336 | .123 | .495 |
| 13 | .118 | .389 | .126 | .430 | .134 | .599 |
| 14 | .152 | .845 | .171 | .925 | .164 | 1.170 |

Wound core with copper and aluminum strips used for protecting amorphous core laminations was compared with a wound core which has Hipersil strip used for protecting amorphous core laminations. The core with Hipersil strips performed slightly better than the core with copper and aluminum strips.

In conclusion, the magnetic core of this invention provides a solution to the problem of protecting an amorphous metal core from its inherent brittleness during the processing and assembling of the coil-core structure for a transformer.

What is claimed is:

1. A magnetic core for use with electrical coils comprising:

a plurality of groups of butt-jointed laminations of an amorphous alloy having high permeability and brittleness as annealed, each group of laminations comprising an external layer of protective material having a melting point above the temperature range of from about 340° C. to about 420° C. and having high permeability in the direction of grain orientation, whereby each lamination group is protected from damage during handling, and the assembly of the laminations of amorphous metal an external layer being in surface-to-surface contact and devoid of interlaminar compounds.

2. The core of claim 1 in which the high permeability, amorphous alloy has an annealing temperature range of from about 340° C. to about 420° C.

3. The core of claim 1 in which the external layer of protective material is comprised of about 3% silicon with the balance being iron and some impurities.

* * * * *